US009486931B2

(12) United States Patent
Posarelli et al.

(10) Patent No.: US 9,486,931 B2
(45) Date of Patent: Nov. 8, 2016

(54) DEVICE FOR THE ROUGH WEEDING OF A MULTILAYER SHEET COMPRISING A SUPPORT LINER AND AT LEAST ONE ADHESIVE FILM COUPLED WITH THE LINER

(71) Applicant: Esanastri S.r.l., Calcinaia (Pisa) (IT)

(72) Inventors: Roberto Posarelli, Calcinaia (IT); Giuliano Vegni, Calci (IT); Cesare Stefanini, Vicopisano (IT); Federico Carnasciali, Pisa (IT)

(73) Assignee: ESANASTRI S.R.L., Calcinaia (Pisa) (IT)

( * ) Notice: Subject to any disclaimer, the term of this patent is extended or adjusted under 35 U.S.C. 154(b) by 33 days.

(21) Appl. No.: 14/437,314

(22) PCT Filed: Oct. 23, 2013

(86) PCT No.: PCT/IB2013/059572
§ 371 (c)(1),
(2) Date: Apr. 21, 2015

(87) PCT Pub. No.: WO2014/087273
PCT Pub. Date: Jun. 12, 2014

(65) Prior Publication Data

US 2015/0283720 A1 Oct. 8, 2015

(30) Foreign Application Priority Data

Oct. 29, 2012 (IT) ..... FI12A0232

(51) Int. Cl.
*B26D 7/00* (2006.01)
*B26D 3/00* (2006.01)
*B26D 7/18* (2006.01)
*B26D 3/08* (2006.01)

(52) U.S. Cl.
CPC ..... *B26D 7/1854* (2013.01); *B26D 3/085* (2013.01); *B26D 7/18* (2013.01); *Y10T 83/0296* (2015.04)

(58) Field of Classification Search
CPC ..... B26D 7/00; B26D 7/1854; B26D 3/00; B26D 3/085; B26D 7/18; B26D 3/08; B26D 7/1845; B65D 7/00; B65D 20/00; B65D 29/00; B65D 35/00; B65D 45/00
See application file for complete search history.

(56) References Cited

U.S. PATENT DOCUMENTS 6,102,097 A 8/2000 Stempien
2007/0261783 A1 11/2007 Larson et al.

FOREIGN PATENT DOCUMENTS

EP 0470645 A1 2/1992

OTHER PUBLICATIONS

International Search Report dated Apr. 2, 2014 for PCT/IB2013/059572.

*Primary Examiner* — Michael N Orlando
*Assistant Examiner* — Matthew Hoover
(74) *Attorney, Agent, or Firm* — Lucas & Mercanti, LLP

(57) ABSTRACT

The present invention concerns the field of graphic apparatuses and in particular its object is an apparatus and a relative method for the so-called "weeding" of plastic or paper films having or more self-adhesive, double sided adhesive or electrostatic layers coupled with a support liner treated with a non-stick agent. The apparatus comprises a seizing head (21) with an air blower (28).

12 Claims, 13 Drawing Sheets

DEVICE FOR THE ROUGH WEEDING OF A MULTILAYER SHEET COMPRISING A SUPPORT LINER AND AT LEAST ONE ADHESIVE FILM COUPLED WITH THE LINER

CROSS-REFERENCE TO RELATED APPLICATIONS

This application is a 371 of PCT/IB2013/059572, filed Oct. 23, 2013 which, in turn, claimed the priority of Italian Patent Application No. F12012A000232 filed on Oct. 29, 2012, both applications are incorporated herein by reference.

TECHNICAL FIELD OF THE INVENTION

The present invention concerns the field of graphic apparatuses and in particular its object is an apparatus and a relative method for the so-called "weeding" of plastic or paper films having or more self-adhesive, double sided adhesive or electrostatic layers coupled with a support liner treated with a non-stick agent.

BACKGROUND OF THE INVENTION

In the preparation of adhesive graphics, simply decorative or also having a protective function, obtained through various printing or through simple engraving processes, a distribution of single graphics is obtained on a single sheet comprising films of the type indicated above, printed and/or cut, coupled with a supporting silicone release paper, or liner. A cutting machine thus has the function of cutting the fringes of the various programmed drawings or writings only on the film, without however cutting also the support/release paper. At this stage there is the need of removing the "weeds", that is, the parts of adhesive film which are not processed and are therefore outside the graphics. In fact, the subsequent user, for his production requirements, needs to have a sheet in which there are only the graphics on the support paper, so that the same graphics can be easily removed and applied as desired.

Such a removal operation of the superfluous film, on the whole also called "weed" for the sake of simplicity, is in fact called weeding. This is a very onerous operation and at the same time delicate since, especially when the contours of the graphics have irregular shapes, or in any case they have indentations or acute curves or undercuts (situation which occurs even with simple alphanumerical characters), the film of weed to be removed tends to tear, leaving residues, or to pull away also the graphical part that should instead be left unaltered. There are also often small parts, typically the internal hollows of characters and writings in general, which require operations that are accurate, precise and repeated.

Such an operation is currently carried out in a completely manual manner, with serious affection of the production time and on labor costs. Automation of the weeding process, despite the attempts made, has been found to be problematic, indeed for the difficulties mentioned above, furthermore enhanced by the fact that the different graphics to be treated and their distribution demand requirements that are always different.

SUMMARY OF THE INVENTION

The present invention, on the other hand, provides a response to this strongly felt need, by providing a series of surprisingly effective technical expedients that make possible to achieve a weeding system that obtains a fully effective result, capable of replacing the manual methods currently in use, with consequent remarkable advantages.

The essential features of a rough weeding device according to the invention are defined in annexed claim 1. Other advantageous features, in connection with preferred or in any case effective embodiments, are the subject of the different dependent claims.

BRIEF DESCRIPTION OF THE DRAWINGS

Characteristics and advantages of the rough weeding device according to the present invention will become apparent from the following description of embodiments thereof, made purely by way of example and not limitative, with reference to the attached drawings in which.

Figure 7:
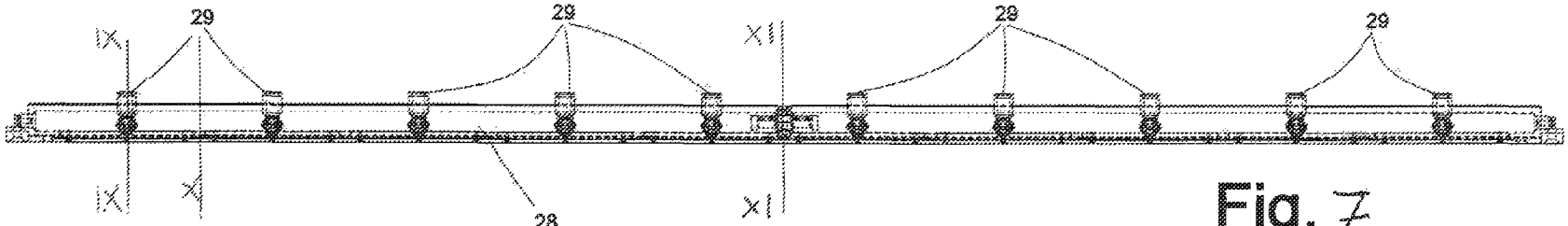
Figure 11:
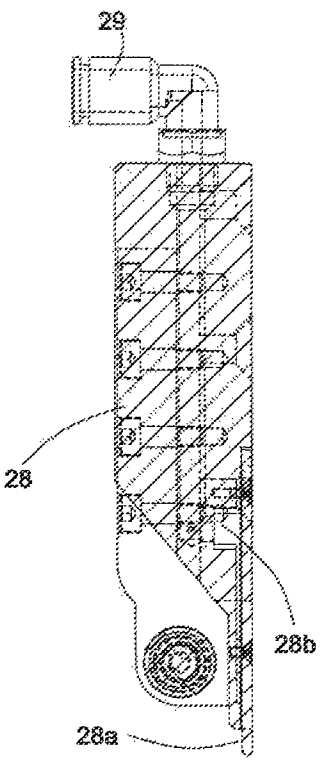
Figure 10:
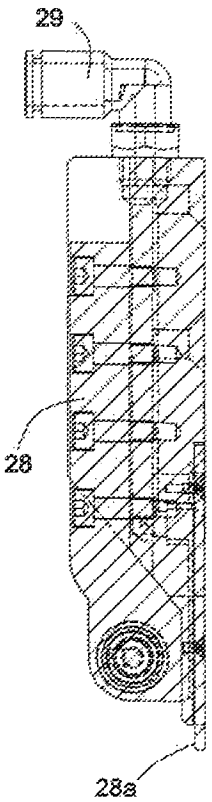
Figure 9:
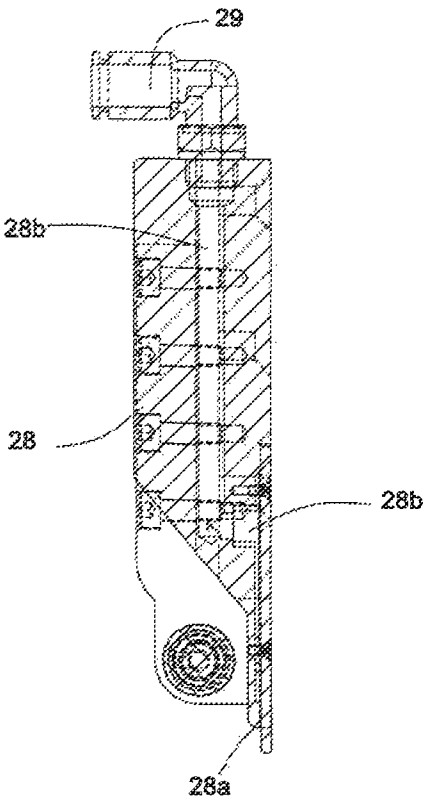
Figure 12:
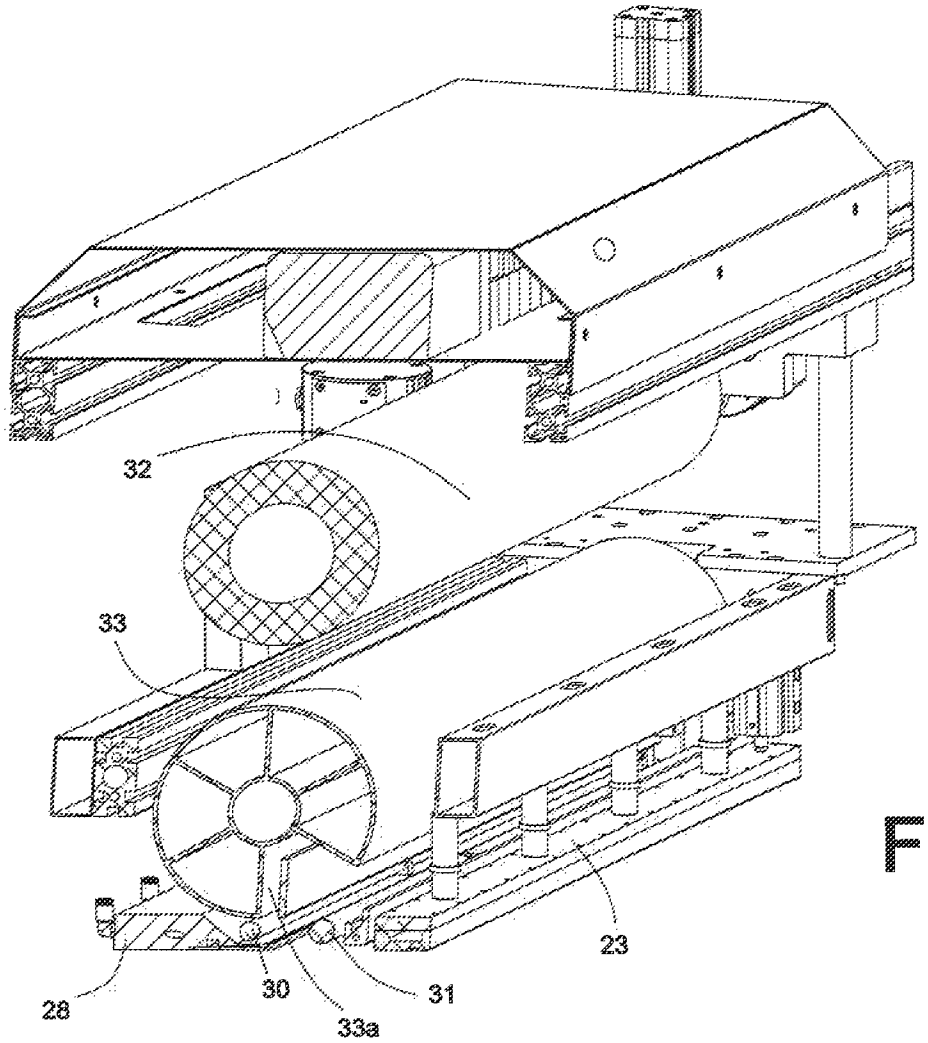
Figure 14:
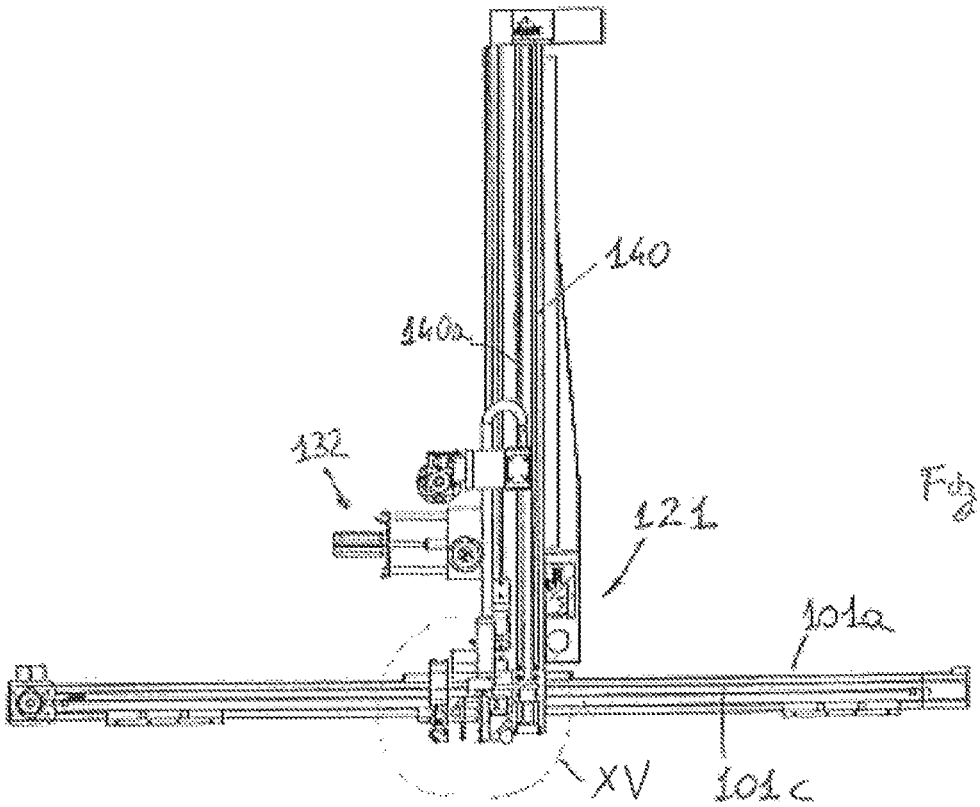
Figure 15:
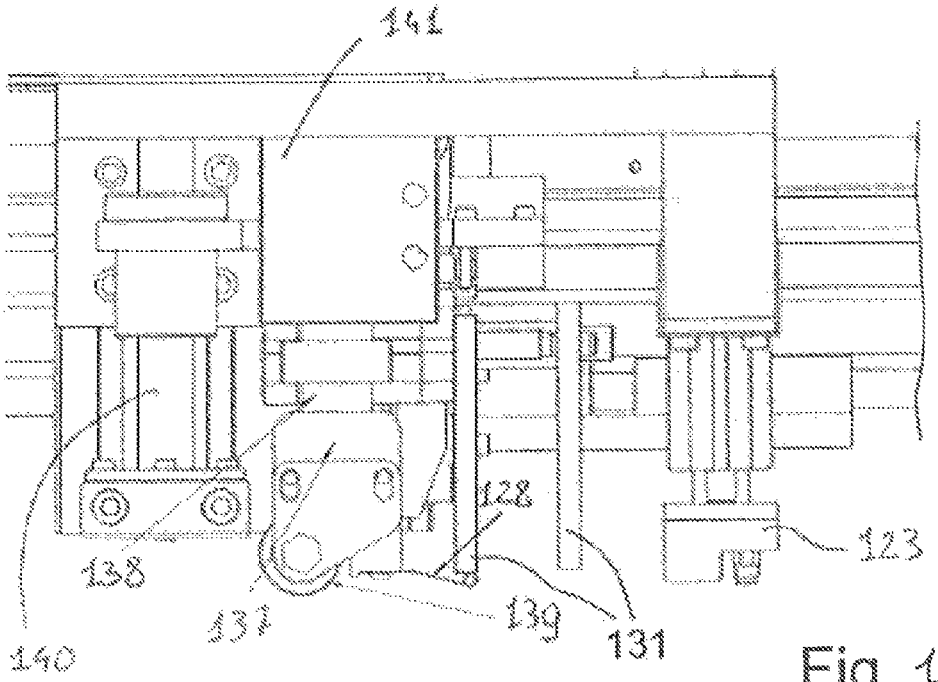
Figure 16:
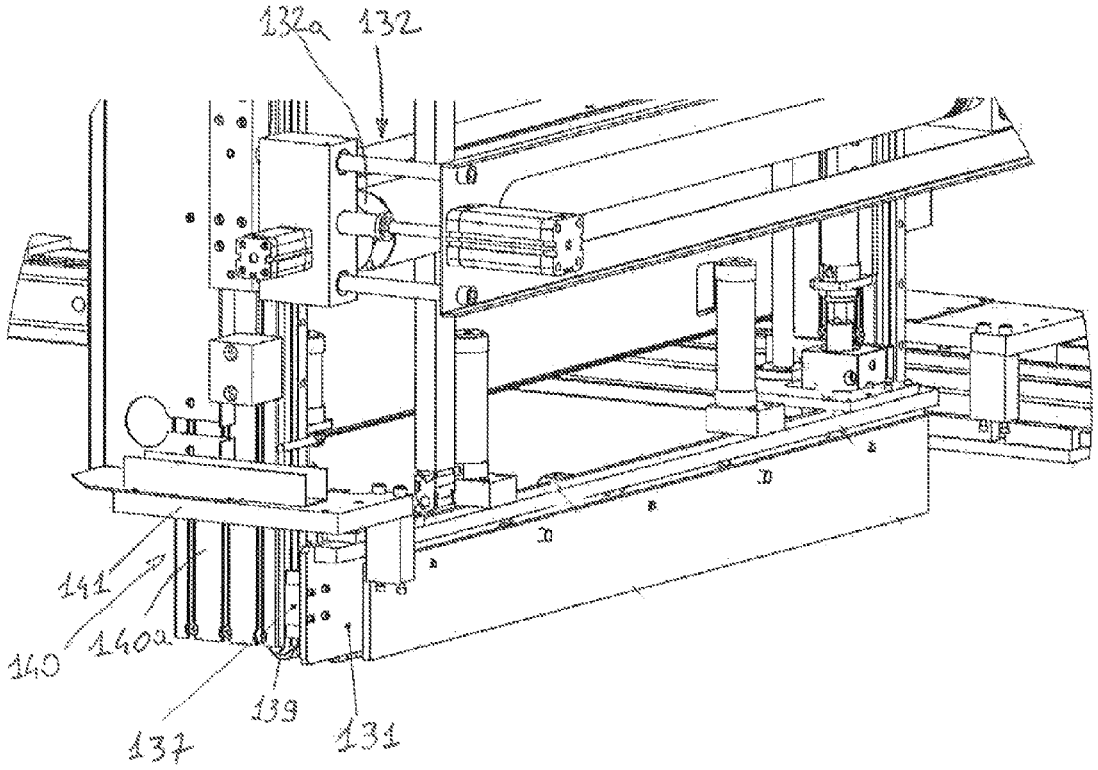
Figure 17:
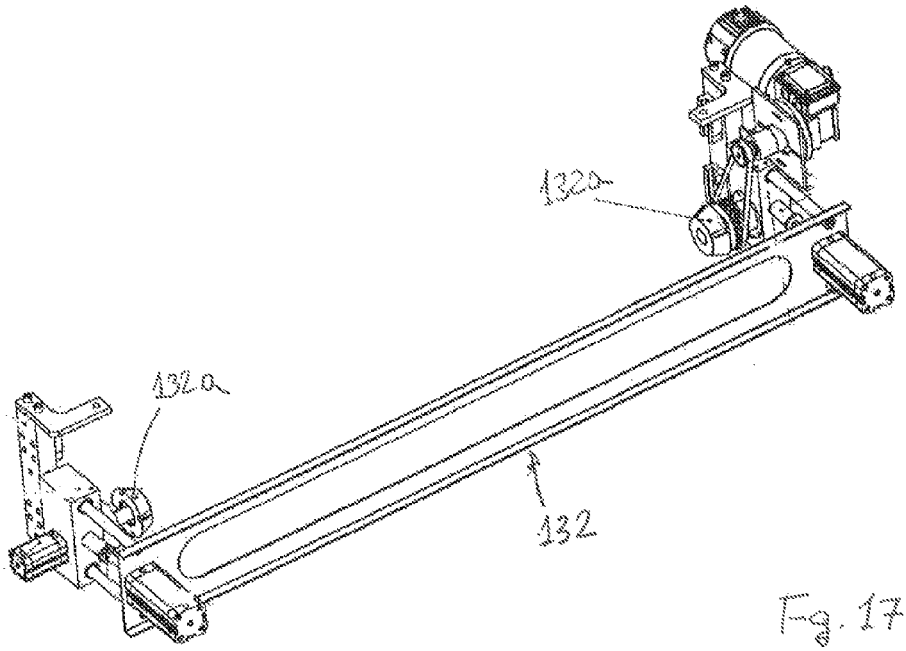

FIGS. from 9 to 11 are cross-section views of the blower in the previous figures, taken respectively along the lines IX, X e XI of FIG. 7;

FIG. 12 is a further representation, in this case partial, schematic, broken and axonometric, of the rough weeding head; and FIGS. from 13*a* to 13*l* represent schematically respective subsequent stages of the rough weeding process;

FIG. 14 is a side view of the device according to a different embodiment of the invention;

FIG. 15 is an enlarged representation, but mirrored, of the area inside the circle XV of FIG. 14;

FIG. 16 is an axonometric view of substantially the same component (seizing head) shown in FIG. 15; and FIG. 17 represents in isolation and in axonometric view weed collection unit in accordance with the second embodiment of the invention.

DETAILED DESCRIPTION OF THE INVENTION

With reference to said figures, an apparatus according to the invention is intended to automatically remove the weed, which advantageously undergoes a pre-emptive cutting operation, with suitably positioned assisting cuts that are added to the conventional ones that define the periphery/outline of the various graphic elements. The cuts, carried out with conventional plotters, in turn have the characteristic of cutting the self-adhesive, adhesive or electrostatic, plastic or paper film, without affecting the support paper or liner. The present invention concerns the actual weeding apparatus, per se provided with novel and advantageous structural and functional characteristics.

The apparatus comprises a frame 1 equipped with a top plane 1*a* on which through known pneumatic systems the sheets of material to be weeded are fed and moved forward. Upstream of the plane there is arranged a feeder 2, advantageously having a lifting surface, with a motorised control, on which to position the sheets with dimensions that can vary from 200×300 mm to 1000×1400 mm or also reels having corresponding size. The plane 2*a* of the feeder can comprise, along two consecutive sides, mechanical abutments that are suitable for allowing a reference of the sides of the sheet, the so-called "print register" sides. This, along with the control of the height of the plane, ensures that when a stack of sheets is arranged on the plane, the sheet on top, intended to be processed, is always positioned perfectly with respect to the work plane 1*a* of the frame 1.

Figure 1:
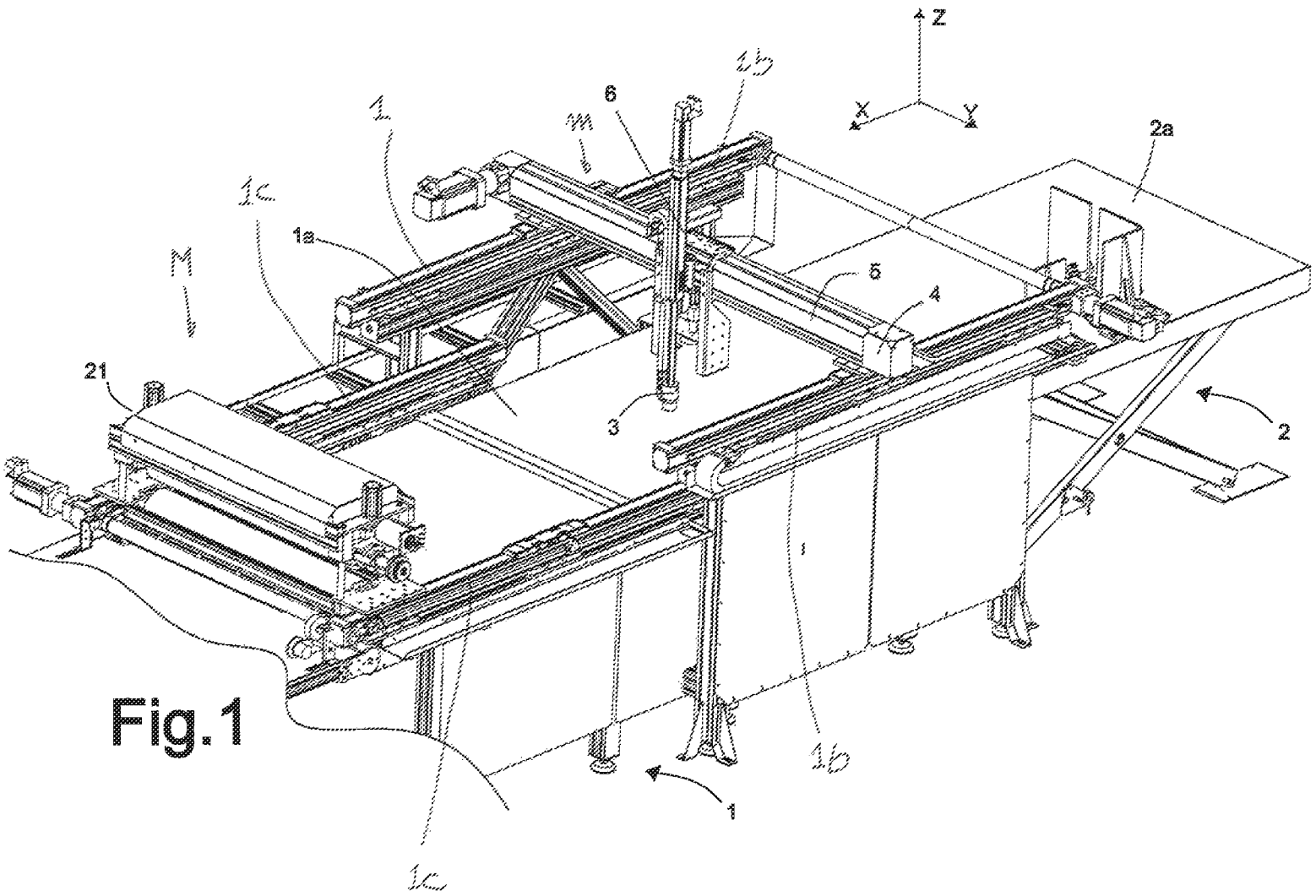
FIG. 1 is a schematic axonometric view of an apparatus comprising a rough weeding device according to the invention.
Figure 2:
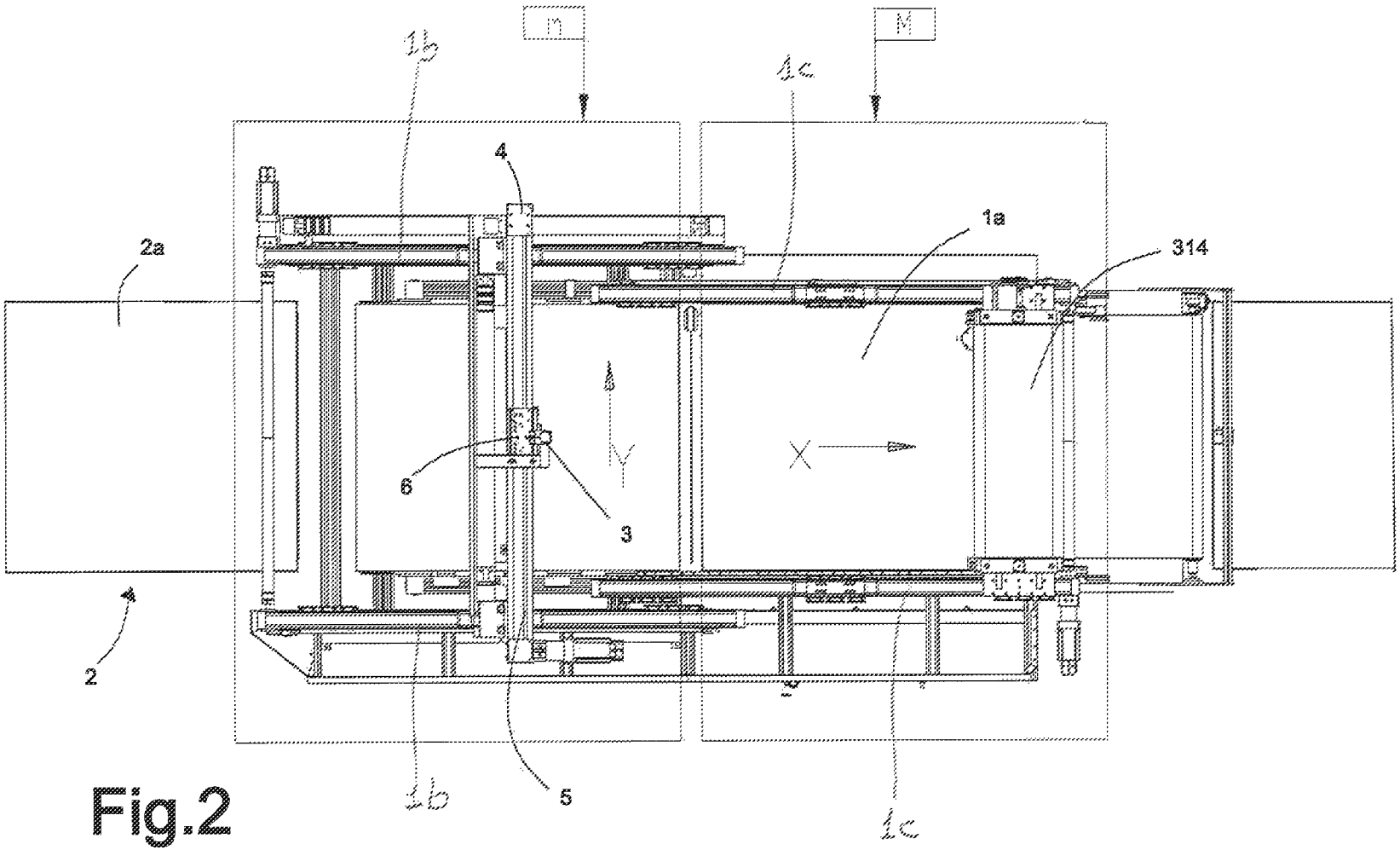
FIG. 2 is a top plan view of the apparatus.

A first part of the plane 1*a*, taking as a reference the advancement direction of the material indicated with the arrow X of FIG. 2, represents a fine weeding station m, that is a station of fine removal of small parts of weed, including those parts that are generated by a plurality of weeding assisting cuts. Once the fine weeding has been carried out, the main body of the weed (through a rough weeding station/process M which will be described in greater detail hereafter) can be detached completely and effectively, without leaving residues, without tearing material or removing undesired parts.

A fine weeding device operates at the fine weeding station m (FIG. 2), with a gripper 3 that a portal 4 supports in a vertical arrangement, allowing the gripper to move along the three coordinates XYZ, in which the plane XY is the one parallel to the plane 1*a* and the axis Z is the direction along which the gripper 3 extends.

To such a purpose the portal 4 has a crosspiece 5 which can be displaced along the advancement direction X and along which a carriage 6 moves, in accordance with the direction Y, and in turn supports the fine weeding gripper 3 through a linear actuation system along the direction Z. All such movements, just like those that are not specified otherwise, are controlled by motorizations implemented as obvious to a person skilled in the art. It is in any case worth noting how the movement along Z of the gripper 3 is advantageously carried out by means of a recirculating ball system driven by a direct brushless motor that ensures speed and precision with a repeatability in the order of a hundredth of a millimetre.

The portal 4 also has a suction rod, which is not visible in the figures, which through a suction pad system feeds the sheet and arranges it so as to align the front left corner (imagining an observer which is standing looking towards the same direction as the advance movement direction) with a suitably pre-set reference. During transport the sheet remains lifted in the front part that is gripped by the suction pads but is progressively made to adhere to the plane la in the remaining part towards the tail. The plane 1*a* is indeed connected to a vacuum pump system and the friction of the sheet created by the suction during movement ensures a perfect flatness preventing air bubbles or creases from forming on the sheet itself.

Once the sheet has been positioned on the suction work plane at the fine weeding station m, the gripper 3 can carry out the fine removal of the various (small) weed parts, including those created by the plurality of weeding assisting cuts, according to the instructions from the control system, in turn processed on the basis of technical criteria that shall be further explained hereafter.

Figure 3:
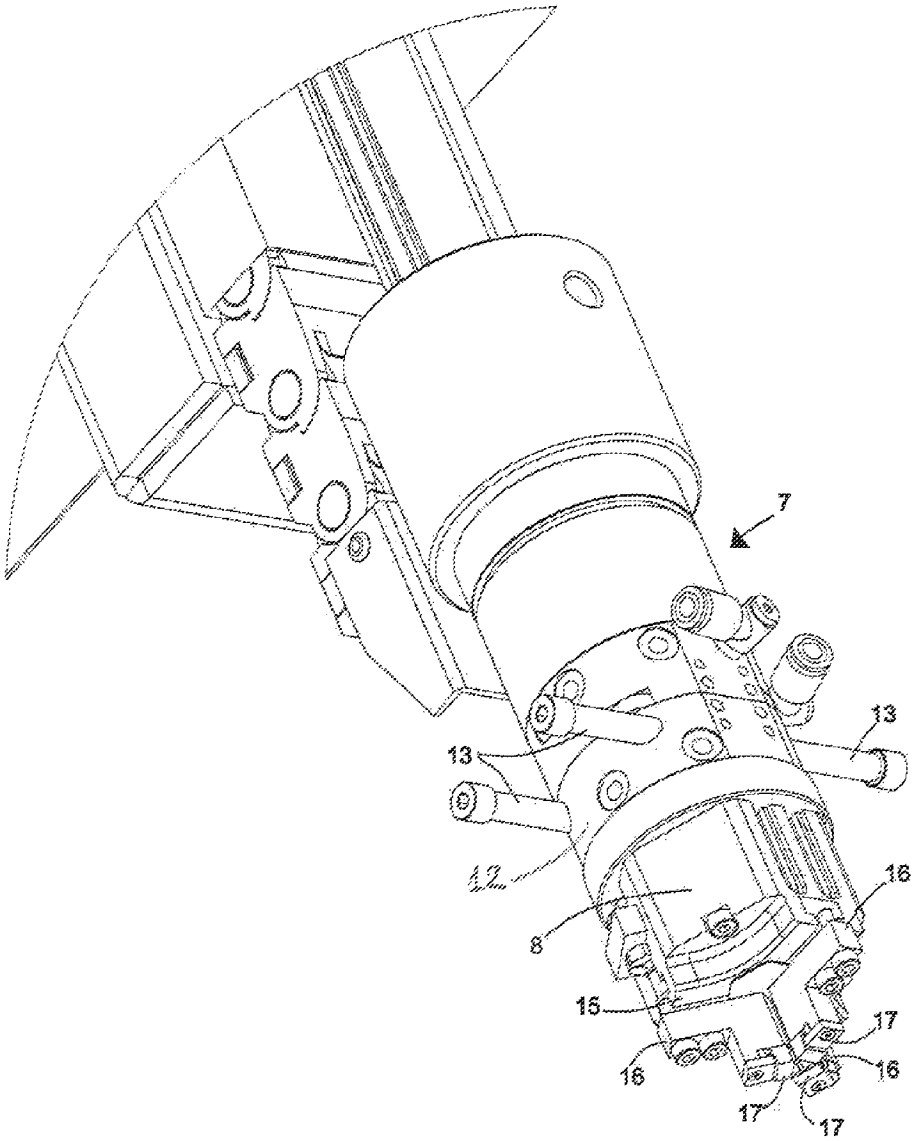
FIG. 3 is an axonometric view from below of a gripper of a fine weeding device of the apparatus.

The gripper 3 is represented in particular in FIG. 3 and includes from top to bottom (the reference is at the work position in alignment with the axis Z) a damper 7 and a pinching or gripping head 8 adapted to come into contact with the adhesive film and to remove it through pinching and lifting, without of course affecting the liner support underneath. The damper 7 has the function of ensuring that the head 8 exerts a pressure with constant intensity on the material to be worked, compensating for possible non-homogeneity in shape of the suction plane.

The head 8 moreover comprises an annular tool-holding flange 12 that can be coaxially connected in a reversible manner, with a quick fit system that can be driven pneumatically, at an inner stem (not visible) of the damper 7. Once it is removed, the flange can be supported in a suitable manner on a tool changing station through four pins 13 projecting radially from the flange itself. A self-centring pneumatically driven chuck 15 is connected to the flange 12, again coaxially, on the opposite side of the damper 7. The chuck is equipped with three radial jaws 16 provided with respective pinching blocks 17 which represent the actual manipulation element of the film/weed to be removed.

In operation, each fine weeding step thus occurs, in brief, with the positioning of the gripper on the appropriate coordinates XY, the jaws being in the open configuration. The device then goes down along the axis Z closing the jaws in a synchronised manner in order to complete the run as they come into contact with the weed to be removed, which is thus gripped between the blocks 17 that are mutually tightened. This action causes there to be a first detachment of the weed, the removal of which is completed with a displacement along XY a new lifting along axis Z and the subsequent unloading or discharge over a sliding belt made from consumable plastic or paper material, with an obvious configuration which is not shown, in view of a new step as the one here just described.

Figure 4:
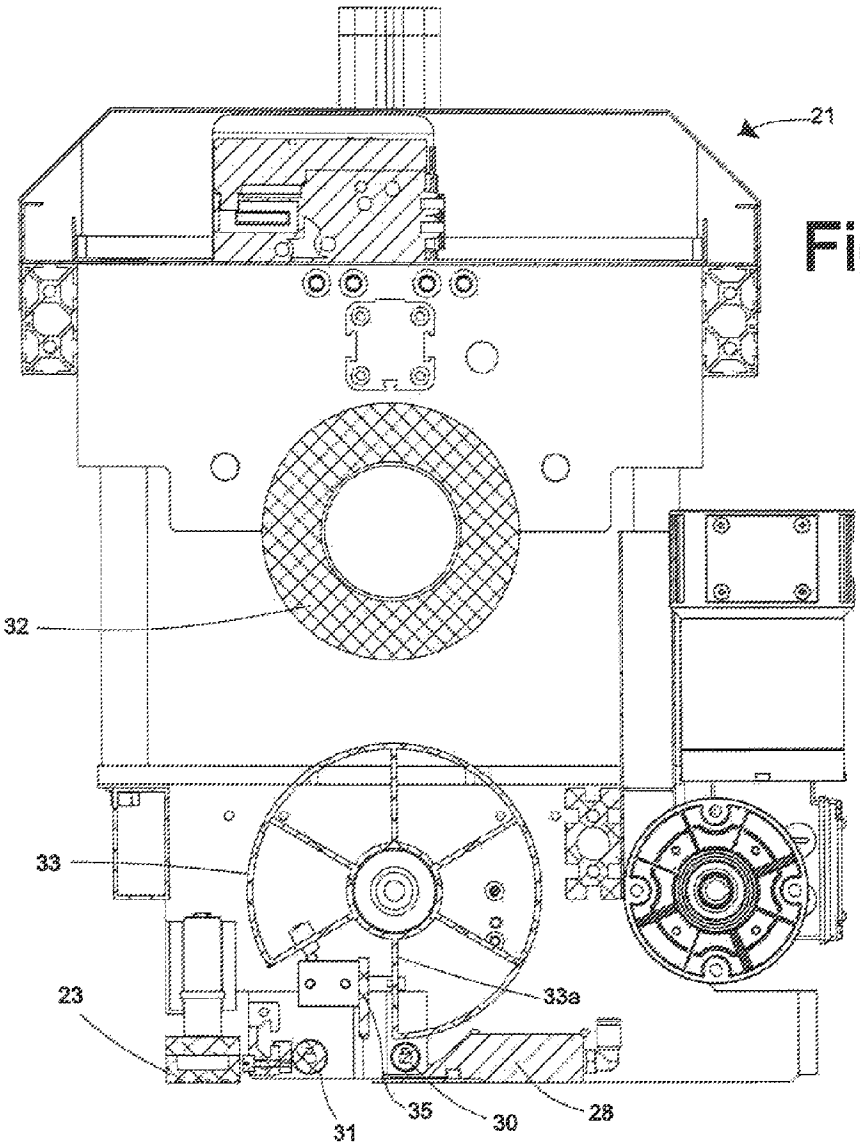
FIG. 4 is a sectional view taken along a longitudinal plane of the apparatus of a seizing head of a rough weeding device according to the invention.
Figure 5:
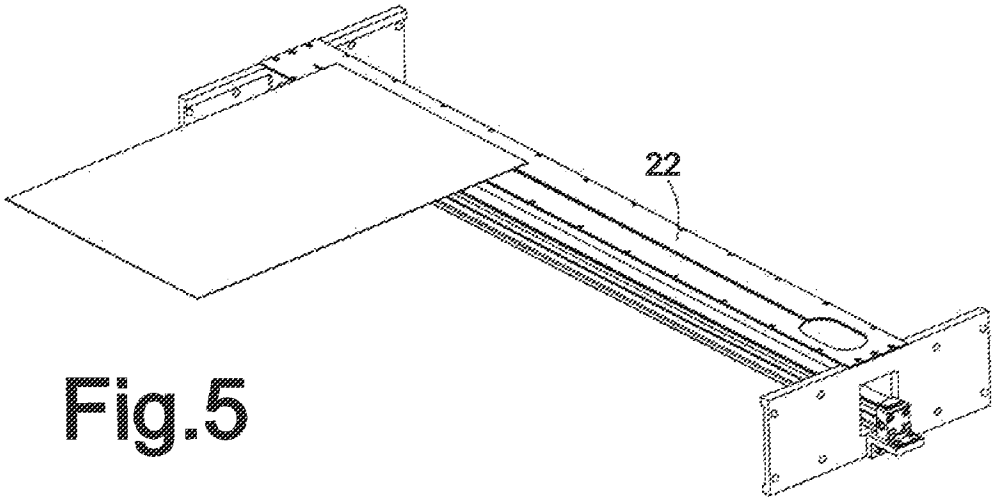
FIG. 5 and FIG. 6 represent, respectively in an axonometric and a side view, a cutting device used in the apparatus according to the invention.
Figure 6:
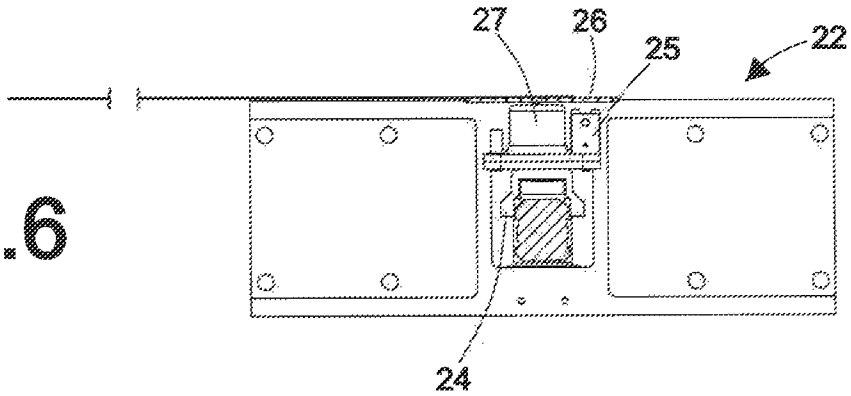
Figure 8:
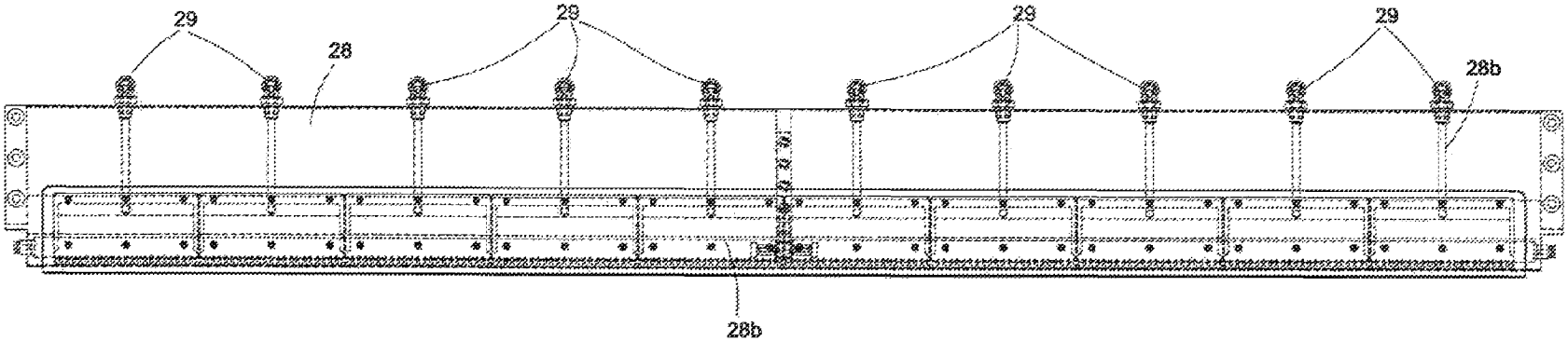
FIGS. 7 and 8 are, respectively, a front view and a top plan view of a blower of the rough weeding head of FIG. 4.

Once the fine weeding phase is over, the sheet proceeds over the plane 1*a* and thus enters the already mentioned rough weeding station M in which a weed seizing head 21 of a rough weeding device operates (FIG. 4 and FIGS. from 7 to 12), cooperating in an initial phase with a cutting unit 22 (FIGS. 5 and 6). The rough weeding device has the configuration of a crosspiece arranged along the axis Y above the plane 1*a* and it is supported in a mobile manner along the axis X by a lateral guide system 1*c* of the plane itself. An adjustment of the position along the axis Z can be also provided, through for example abutment screws to be actuated manually.

The seizing unit or head 21 comprises a front suction rod 23 that takes hold of the sheet and positions it above the cutting unit 22, embedded in the plane 1*a* in an inlet position of the rough weeding station M. In this phase, the suction system of the rough weeding head 21 carries out an opposing effect to the action of a blade housed inside a self-lubricating disk 27 that moves along the axis Y, controlled by a pneumatic piston, through a recirculating ball slide on the entire length of a linear guide 24. The liner of silicone release paper placed under the self-adhesive plastic material is cut for its entire width at a distance of around 2.5 cm from the front edge of the sheet, so as to define a flap or edge that can be easily folded upwards, with the consequence and the aim that shall soon become clear. The precision with which the blade sinks into the liner is ensured by a micrometer screw, whereas the stop abutment of the knife is ensured by a pneumatic piston 25 that brings the disk 27 in contact with the supporting plane of the sheet. The gap on the axis Z between the knife and the disk thus defines the depth of the cut.

Once the liner has been cut, the sheet still held by the suction rod 23 is brought inside the actual rough weeding station M, making the cutting line of the liner coincide with a reference mark of a device for lifting the head flap of the liner. Such a device is schematically represented and indicated with reference numeral 36 in FIGS. from 13*b* to 13*l*, and it consists substantially of a bar that can be lifted along the axis Z through linear pneumatic actuators that are not represented, between a lowered position in which it is concealingly integrated inside the plane 1*a* and a raised position in which it is capable of folding upwards by 90° the front flap or edge of the sheet, defined by the cutting means indicated above.

The lifting strip is preferably shaped with a staggered or comb-shaped edge that engages with a matching shape of the rough weeding plane, so as to lift the flap or edge at the end margin of the suction area, i.e. with the suction that is in any case active between the teeth of the staggering/comb and assists a lift precisely by 90° of the flap or edge.

A further component of the weed seizing head is a blower 28 that, on a plane that is parallel and adjacent to the plane 1*a*, produces an ejection of pressurised air that is capable of covering the entire width (direction Y) and is directed according to X, in a direction that is in accordance with that along which the sheet advances forward. Advantageously, the blower 28, shown in particular in FIGS. from 7 to 10, takes the shape of an elongated blade extending along the axis Y with a plurality of adjacent and independent sectors, for example ten, that are driven by respective solenoid valves 29 in order to dispense air, through suitable channels 28*b*, during the movement of the sheet only where actually required.

The pressurised air comes out from a system of front slits 28*a* of the blower, to which a pair of rollers 30, 31 are associated, spaced along the direction X and arranged so that the blade is substantially tangent with respect to them. More precisely, a rear roller 30 is made from silicone material, whereas a front roller 31 is preferably made from aluminium with a non-stick coating and is mobile towards and away from the rear roller 30. The rotation of such rollers is controlled by, and is synchronised with, the forward movement of the whole head, through a pinion and rack transmission (the pitch of the rack being in particular the same as the diameter of the two rollers).

In an upper area of the group, and therefore above the components described above, there are a pull drum 33 with an incomplete development (that is, without a circular sector preferably having an angle that is equal or slightly lower than 90°) and above the drum 33, a shaft 32 for collecting the weed in a reel (around a core of disposable cardboard), both motorized and arranged with their rotation axis extending along the axis Y. The motorisation of the roller and the shaft is mutually independent, with a torque limiter that can be set in order to ensure the correct tension of the weed, thus avoiding ripping or accumulation thereof. The winder 32 can moreover translate towards and away from the pull drum 33.

The incomplete pull roll, indeed thanks to its C-shaped section, defines a radial face 33*a* that cooperates with a clamp member 35 so as to be able to lock the weed and pull it.

Figure 13A:
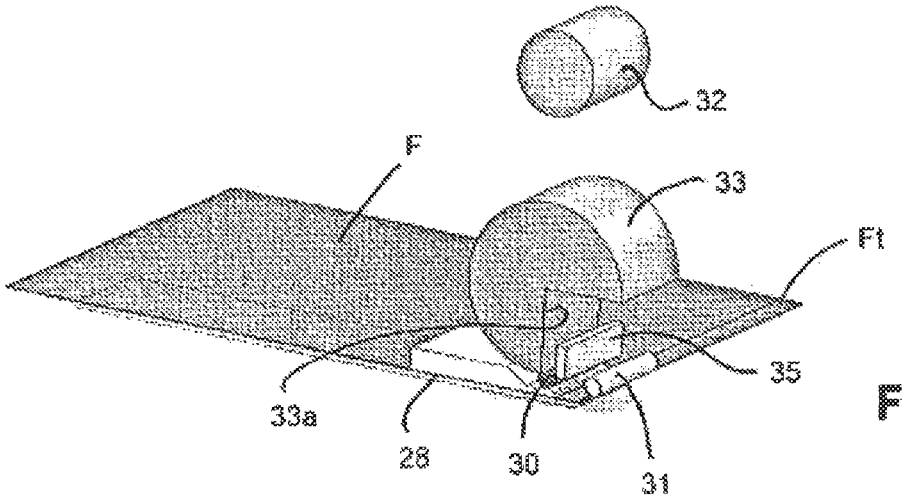
Figure 13B:
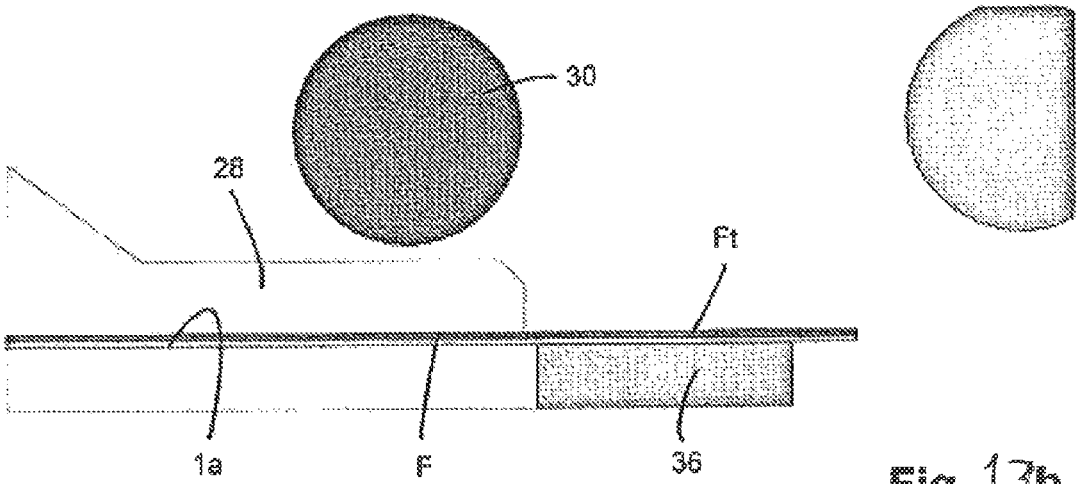

Entering into greater detail as far as the work sequence of the rough weeding process is concerned, and with particular reference to FIGS. from 13*a* to 13*l*, the blower blade 28 is positioned at the front edge of the sheet, indicated with F. In FIG. 17*a* it can be noted also the folding flap Ft indeed generated frontally as a result of the half-cut previously mentioned (cutting line indicated with L). Initially, the radial face 33*a* of the C-shaped drum 33 is arranged perpendicular with the plane 1*a*, tangent to the back roller 30 and substantially aligned with the cutting line L. Also the front margin of the blower blade is positioned precisely in a way such as to coincide with the cutting line L. The clamp member 35 is open and the front roller 31 is in a forward displaced position (FIGS. 13*a* and 13*b*).

Figure 13C:
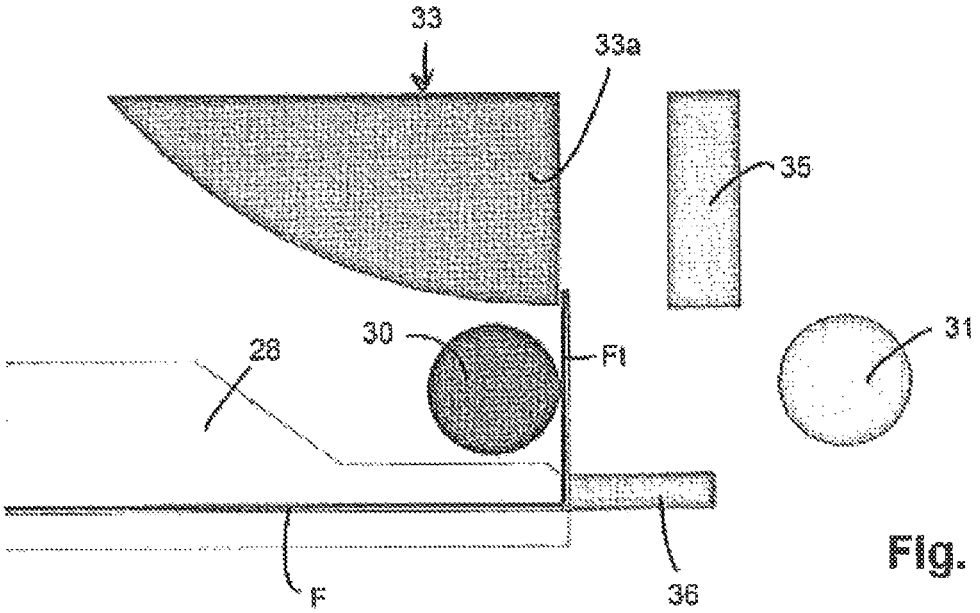
Figure 13D:
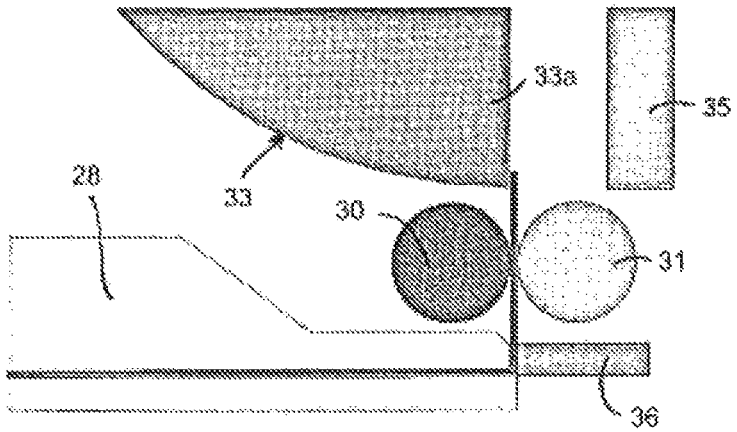
Figure 13E:
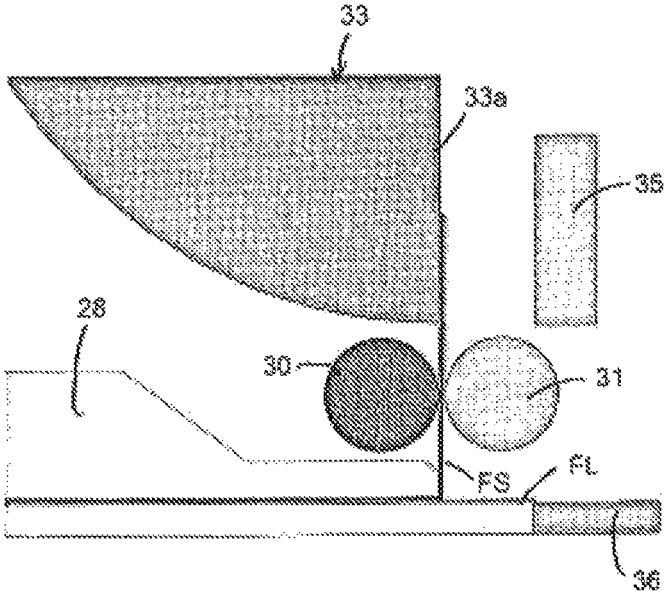

As a result of the lifting of the folder 36, the folding flap Ft, including both the weed Fs and the liner Fl joined to one another, is folded upwards (FIG. 13*c*). At this stage the front roller 31 retracts (FIG. 13*d*) and in cooperation with the rear roller 30 seizes the material, in contact with the adhesive side and directs it upward, whereas, at the same time, the head retracts in direction X, in opposite fashion to the advancement motion of the sheet (FIGS. 13*d* and 13*e*). While this occurs the weed Fs starts becoming detached from the liner of silicone release paper Fl, with the latter kept in contact with the plane la thanks to the suction exerted by it and to the jet of the blower 28 which is responsible for the function, useful in some cases, of preventing the lifting of small parts belonging to the graphics and that must indeed stay placed on the liner.

Figure 13F:
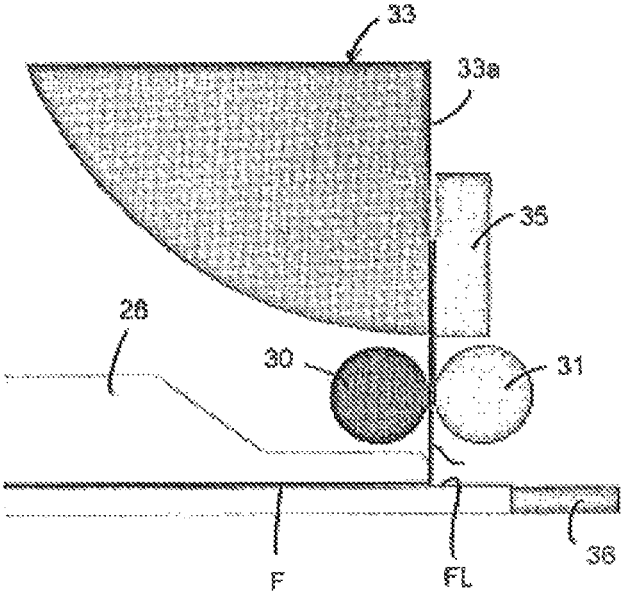
Figure 13G:
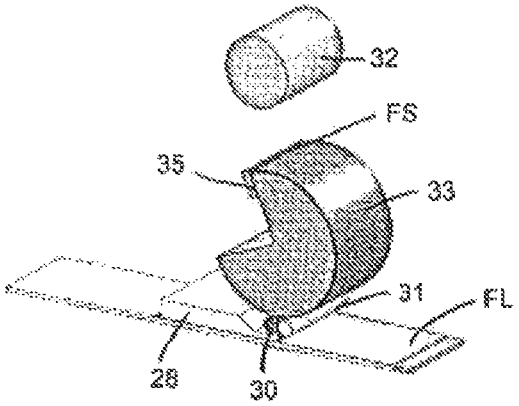
Figure 13H:
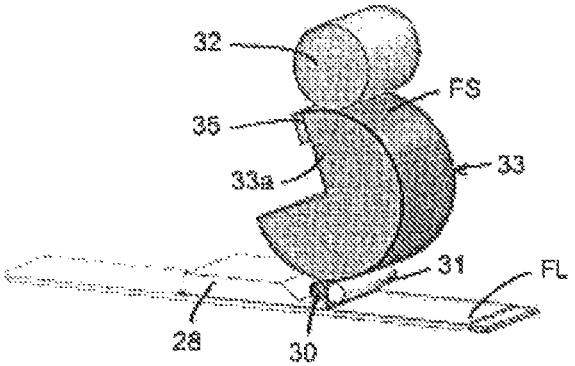
Figure 13I:
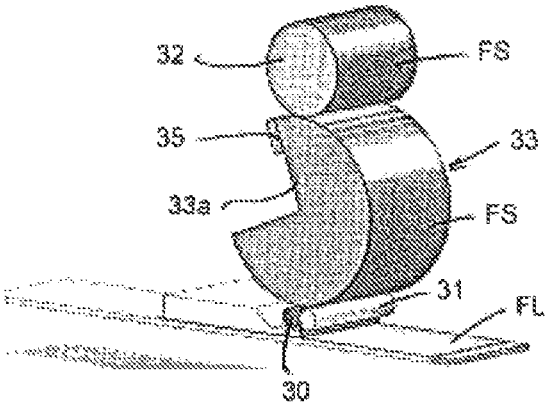
Figure 13J:
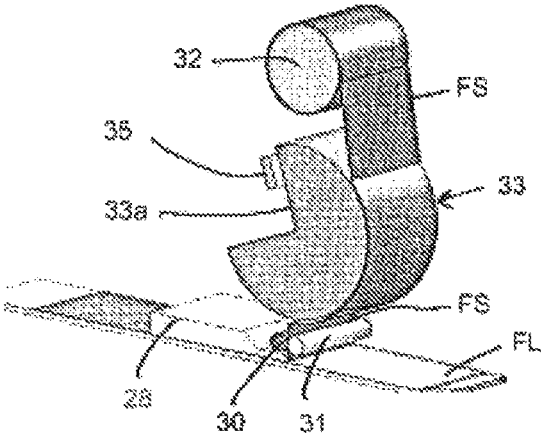

As visible from FIG. 13*f*, the weed Fs has been fed onto the radial face 33*a* of the pull drum 33 and the clamp member 35 can close to lock it. A rotation of the drum 33 at this stage continues the removal of the weed Fs which is circumferentially wound around the roll, while in a coordinated manner, the head unit continues to move rearwards. The rotation also brings the weed to the shaft 32 bearing the winding core. In order to start collecting, the shaft 32 moves tangentially alongside the drum 33 (FIG. 13*h*) so as to be, in turn, wrapped up by the same weed (FIG. 13*i*). Once the winding has been triggered, the shaft can lift up so as to allow it to freely expand its diameter (FIG. 13*l*). Of course, for each treated sheet, the aforementioned sequence is repeated and the reel of collected weed continues to grow. Once the diameter of such a reel has reached a set size, a sensor detects it, and stops the apparatus so as to allow the reel itself to be extracted and replaced with an empty cardboard core.

Once made clear that the blower is not necessarily turned on in every circumstances (being it possible that with some materials under treatment the effectiveness of the result is not jeopardized by a lack of the pneumatic action), in a different embodiment, shown in FIGS. from 14 to 17, the seizing head is provided with a movement of lifting/pulling the weed along the vertical axis Z, movement that in practice replaces the rotation of the rollers 30, 31 and the winding over the pull drum 33, and by the same roll, in the first embodiment above described.

The seizing head in this case is indicated with the numeral 121, and is arranged, in structure and working process, in an analogous fashion with respect to the first embodiment as far as the initial steps are concerned (positioning the sheet and "half cut"). Accordingly, a further description of these steps is here omitted. The figures show a number of components that correspond to those of the previous embodiment, and are therefore indicated with a corresponding numeral in three digits (e. the suction bar 123).

The flap obtained with the "half cut", connected to the rest of the sheet only via the plastic film, is therefore the seizing point that allows for the start of the detachment of the weed, to "free" the graphics. For the sake of a correct working, it is important that the processed sheet be positioned precisely on the suction plane, so that the rear cut results exactly on the folding/lifting line of the flap in the cutting unit; to this purpose the hold carried out by the suction system is kept active during the whole process, to have an appropriate reference for the displacement of the sheet from the half-cut zone to the rough weeding zone.

A blower blade is in this case indicated with the numeral 128 and, suitably turned on by electrovalves, can deliver air during the movement only when and where positively required; the function of this air ejections is as mentioned fundamentally to oppose a possible lift of the graphic parts as the weed is removed. The structure of the blade has a certain flexibility to better accompany the sliding of the removed material and the interaction therewith even when it follows irregular geometric contours due to the particular graphic under process.

An idle roller 139 is associated to the blade 128 and is preferably lined with a silicon material in view of a better grip on the plastic film, In fact, the task of this roller is to lock the sliding of the sheet during the rough weeding process, ensuring a safer hold on the same sheet by the suction plane. Moreover, the compression of the drum on the self-adhesive material ensures that the graphic figures remain attached to the support liner and consequently prevents their lifting/removal as the weed is detached.

The unit including the blade 128 and the roller 139 is mounted on a common movable support 137, the position of which can be adjusted in the direction Z thanks to recirculating ball linear sliders 138 driven by pneumatic pistons. The result thus obtainable is to drive with a certain adjustable pressure the blade and the roller onto the material during the weeding steps, and to lift the blade in the inactive steps, that is when the unit must be moved without engagement with the sheet material.

The seizure of the weed occurs via plate members 131 seizing the lifted flap and moving upwards, carried by a slider 141, rising continuously in height along the direction Z, guided by a portal 140 and namely by linear guide means 140*a* thereof. The rising is coordinated with the movement of the same portal along the direction X (movement that occurs as in the previous embodiments, and followed by the support 127 of the blade 128 and of the roller 139 that, contrary to the seizing means 131, remain adjacent with the working plane pressing the sheet). As a function of the different types of material under treatment, it is possible to set the appropriate weed removal strategy by synchronizing the two movements, so that a constant and precise pull of the material is ensured during the whole process as required by the different shapes of the graphics. Depending on the length and nature of the material, it is possible to leave a small portion of the sheet anchored for avoiding fluttering during the movement, thus assisting the subsequent phase of collection of the removed weed.

In this case the collection of the removed weed is carried out by a collection unit 132 (FIG. 17) that rises in height along with the slider 141 on the guide portal, starting from a minimum elevation that is the one the slider has to reach to start the collection. The collection unit 32 comprises two mutually opposed rotating plugs 132*a*, one of which is motorized, that form the shaft on which there is engaged the weed reel cardboard core. The increase in width that results from the accumulation of weed on the collection core is compensated thanks to a horizontal recovery movement (along X) by the plugs 132*a*. The winding movement is obtained thanks to the motorization of one of the two plugs, possibly with a motor with feedback control through an external encoder. Once the width of the reel of wound weed has reached a customizable preset size, an onboard sensor of the slider commands the stop of the apparatus and the replacement of the core, which is permitted thanks to a pneumatic unlock of the non-motorized plug 132*a*.

The various drives are carried out through motors and actuators having an obvious nature to the skilled person and not described in detail.

The present invention provides therefore a weeding device and method capable of making the weeding process effectively automatic (not necessarily in the time order rough after fine as in the example, but possibly even in the contrary order), remarkably reducing the production times and significantly improving the productive results as far as costs and reliability are concerned.

The present invention has been here described with reference to its preferred embodiment. It should be understood that that there may be other embodiments within the same inventive concept, as defined by the scope of protection of the following claims.

The invention claimed is:

1. A device for the rough weeding of a multilayer sheet comprising a support liner and at least one adhesive film coupled with the liner, the film comprising a plurality of graphic elements peripherally encircled by cuts and a weed among said graphic elements, the device comprising a sheet support plane defining a feeding direction (X), and a seizing head extending above said plane along a transverse direction (Y) crosswise with respect to said feeding direction, support and drive means adapted to drive said seizing head at least according to said feeding direction (X), wherein said seizing head is adapted to emit a pressurized air ejection substantially parallel with and adjacent to said plane with an ejection direction concordant with said feeding direction (X), and comprises seizing means comprising in turn at least one pair of seizing members adapted to seize said weed, whereby a relative motion between the seizing head and the sheet is adapted to detach the weed from the support liner, said air ejection providing for a stabilization and control of the weeding action, the device further comprising cutting means arranged along said transverse direction (Y), flush within said plane and adapted to cut only the supporting liner to realize a sheet flap foldable upwards, to assist the engagement with said seizing head, and folding means associated with said cutting means and adapted to be lifted from the plane in order to fold said flap.

2. The device according to claim 1, wherein said pressurized air ejection extends over the whole width of said plane concordantly with the sheet feeding direction, due to an elongated air ejection blade with a plurality of side by side sectors controlled by respective electrovalves adapted to be operated selectively and independently.

3. The device according to claim 2, wherein said seizing members comprise a pair of rollers having axis extending along said transverse direction (Y), spaced with respect to the feeding direction (X) and arranged so that said blade is substantially tangent to them, the pair comprising a rear roller with a fixed axis and a front roller the axis of which is displaceable close to and away from the rear roller, the operation of the rollers being coordinated with said relative movement between the head and the plane according to said feeding direction (X).

4. The device according to claim 3, wherein said rear roller is made of a silicone material, while the front roller is made of a metallic material with a non-stick coating.

5. The device according to claim 3, wherein said seizing means comprise above said rollers and said blade a pull drum displaceable along with said rollers and said blade according to said relative movement in said feeding direction, the pull drum having in turn again a transverse axis and an incomplete development, that is, lacking of a circular sector, so as to define a radial face cooperating with a clamp for seizing and pulling the detached weed, a shaft for collecting the weed in a reel being provided above the pull drum, the shaft being in turn displaceable according to said feeding direction (X) with the rollers and the blade, but also displaceable close to and away from relative to the pull drum the drum and the shaft being motorized in a mutually independent manner.

6. The device according to claim 2, wherein said seizing head comprises a slider supporting said seizing members, the slider being movable on linear guide means along a direction (Z) orthogonal with said plane said linear guide means being defined by a portal that rises from the plane and is movable with respect to it according to sais feeding direction (X), dragging therewith said blower blade.

7. The device according to claim 6, wherein an idle roller is associated to said blade, adapted to press the sheet against said plane.

8. The device according to claim 6, wherein said portal further supports in a movable manner along said linear guide means a weed collecting unit for collecting the weed detached by said seizing members.

9. A method for the rough weeding of a multilayer sheet comprising a support liner and at least one adhesive film coupled with the liner, the film comprising in turn a plurality of graphic elements peripherally encircled by cuts and a weed among said graphic elements, the sheet being fed horizontally over a plane along a feeding direction (X), the method comprising the following steps: cutting only the liner along a transverse direction (Y) crosswise with respect to said feeding direction on said plane so as to realize a sheet flap that is foldable upwards; lifting said flap; mechanically seizing said flap with seizing means; detaching the weed from the liner as a result of a relative motion, along said feeding direction (X), between said seizing means and said sheet, simultaneously exerting a pneumatic ejection on the sheet from the side of said weed, on a horizontal plane and concordantly with said feeding direction (X), for stabilizing and controlling the detachment of the weed from the liner.

10. The method according to claim 9, wherein said ejection is carried out throughout the transverse direction (Y) and is selectively controlled in a variable manner along the same transverse direction.

11. The method according to claim 9, wherein said detachment is further associated with a rotating motion of said seizing means or of a part thereof, around an axis extending along said transverse direction (Y).

12. The method according to claim 9, wherein said detachment further provides a translation of said seizing means or a part thereof along a direction (Z) orthogonal with said plane.

* * * * *